US006654477B1

(12) United States Patent
Miller et al.

(10) Patent No.: US 6,654,477 B1
(45) Date of Patent: Nov. 25, 2003

(54) RECEIVER AND METHOD OF CONSTRUCTION

(75) Inventors: Thomas E. Miller, Arlington Heights, IL (US); Elmer V. Carlson, Glenview, IL (US)

(73) Assignee: Knowles Electronics, Inc., Itasca, IL (US)

( * ) Notice: Subject to any disclaimer, the term of this patent is extended or adjusted under 35 U.S.C. 154(b) by 73 days.

(21) Appl. No.: 08/943,669

(22) Filed: Oct. 15, 1997

(51) Int. Cl.[7] ..... H04R 25/00

(52) U.S. Cl. ..... 381/412; 381/415; 381/413; 381/397; 381/417

(58) Field of Search ..... 381/396, 417, 381/418, 419, 421, 422, 415, 413, 414, 397, 312, 322

(56) References Cited

U.S. PATENT DOCUMENTS

| | | | | |
|---|---|---|---|---|
| 3,617,654 | A | * | 11/1971 | Heidrich |
| 3,777,078 | A | * | 12/1973 | Boustros-attia et al. .. 179/114 A |
| 4,054,965 | A | * | 10/1977 | Vig |
| 4,201,953 | A | * | 5/1980 | Robbins |
| 4,272,654 | A | * | 6/1981 | Carlson ..... 179/119 A |
| 4,319,098 | A | * | 3/1982 | Baitcher |
| 4,518,831 | A | * | 5/1985 | Stanley et al. ..... 179/119 A |
| 5,193,116 | A | * | 3/1993 | Mostardo |
| 5,255,328 | A | * | 10/1993 | Akiniwa |
| 5,337,033 | A | | 8/1994 | Kinouchi et al. |
| 5,398,398 | A | * | 3/1995 | Williams et al. ..... 29/599 |
| 5,461,677 | A | * | 10/1995 | Raj |
| 5,647,013 | A | * | 7/1997 | Salvage |
| 5,708,726 | A | * | 1/1998 | Brinkley et al. ..... 381/200 |
| 5,757,946 | A | * | 5/1998 | Van Schyndel |
| 5,805,040 | A | * | 9/1998 | Corcoran |
| 6,040,397 | A | * | 3/2000 | Hooper et al. |
| 6,041,131 | A | * | 3/2000 | Kirchhoefer et al. |

FOREIGN PATENT DOCUMENTS

| | | |
|---|---|---|
| EP | 0 272 616 | 12/1987 |
| EP | 0 548 579 A1 | 11/1992 |
| GB | 1019368 | 3/1964 |
| GB | 1145027 | 5/1966 |

* cited by examiner

*Primary Examiner*—Curtis Kuntz
*Assistant Examiner*—Dionne N. Harvey
(74) *Attorney, Agent, or Firm*—Marshall, Gerstein & Borun LLP

(57) ABSTRACT

A receiver for converting electrical energy to acoustical energy, and a method of manufacturing the receiver, are disclosed. The receiver comprises an armature having a peripheral edge, a magnet stack and a weld joint for attaching the armature to the magnet stack at the peripheral edge of said armature. The method comprises providing an armature having a peripheral edge, providing a magnet stack adjacent said armature, and welding said armature to the magnet stack at the peripheral edge of said armature.

3 Claims, 1 Drawing Sheet

RECEIVER AND METHOD OF CONSTRUCTION

TECHNICAL FIELD

The present invention relates to a receiver, such as for a hearing aid, and more particularly, to a receiver having an armature welded to the magnet stack at the peripheral edge of the armature.

BACKGROUND OF THE INVENTION

Moving armature transducers, or receivers, such as those used in miniature hearing aids, are sensitive to the crystalline condition of metal parts in the receiver's magnetic circuit. Components in the magnetic circuit should have high permeability, even in the presence of high magnetic fields, if the transducer is to have good distortion performance and high sensitivity. Careful annealing of the metal parts will produce good performance.

One particularly sensitive point is where the armature connects to the metal housing for the magnets, or stack. The armature is normally resistance welded to the stack. This process inevitably damages the magnetic properties of the armature and the stack in the weld area. As these transducers are quite small, the damaged area is a significant portion of the available interface area between the armature and the stack.

Resistive welding is a simple and economical way to attach the armature to the stack. Unfortunately, it is very difficult to limit or control the weld area, as a weld will form anywhere there is good mechanical contact and the current density is high enough.

The present invention is provided to solve these and other problems.

SUMMARY OF THE INVENTION

It is an object of the invention to provide a receiver for converting electrical energy to acoustical energy.

In accordance with the invention, the receiver comprises an armature having a peripheral edge, a magnet stack, and means for attaching the armature to the magnet stack. The attaching means comprises a weld joint at the peripheral edge of the armature.

It is contemplated that the weld joint is a laser weld joint.

It is further contemplated that the weld joint comprises a plurality of spot weld joints disposed on opposing portions of the peripheral edge.

It is still further contemplated that the attaching means includes an adhesive, such as an epoxy disposed between the armature and the stack.

It is a further object of the invention to provide a method of manufacturing a receiver for converting electrical energy to acoustical energy.

In accordance with this aspect of the invention, the method comprises the steps of providing an armature having a peripheral edge, providing a magnet stack adjacent the armature, and welding the armature to the magnet stack at the peripheral edge of the armature.

It is contemplated that the weld joint is a laser weld joint.

It is further contemplated that the weld joint comprises a plurality of spot weld joints disposed on opposing portions of the peripheral edge.

It is still further contemplated that the method includes the step of providing an adhesive, such as an epoxy, disposed between the armature and the stack.

Other advantages and aspects of the present invention will become apparent upon reading the following description of the drawings and detailed description of the invention.

DETAILED DESCRIPTION

Figure 2:
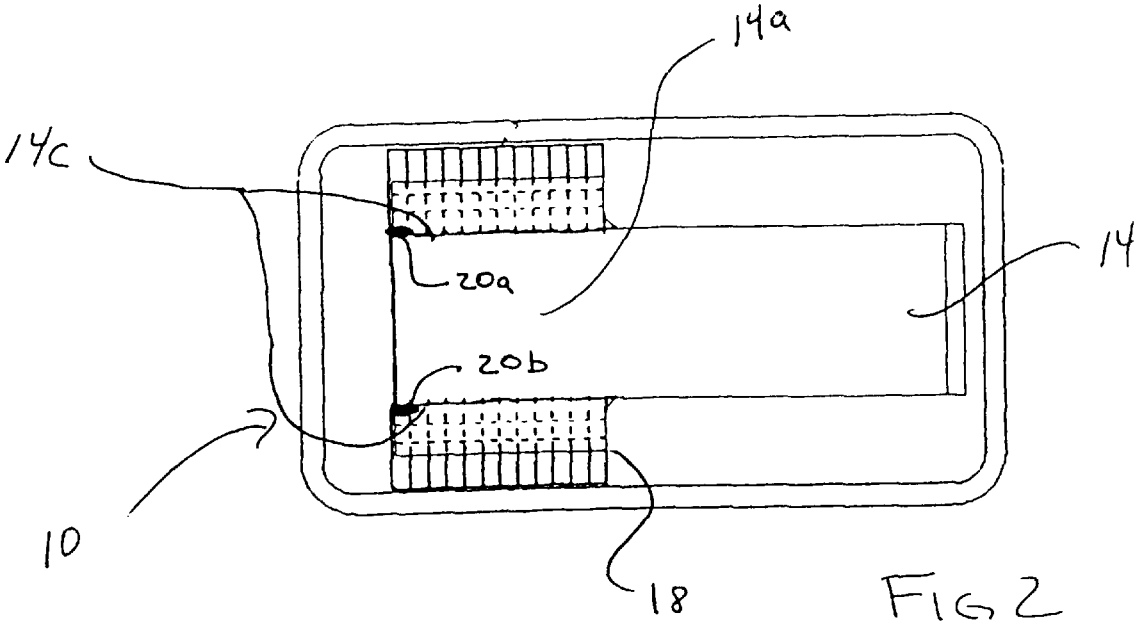
FIG. 2 is a plan view of the receiver of Figure

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 1:
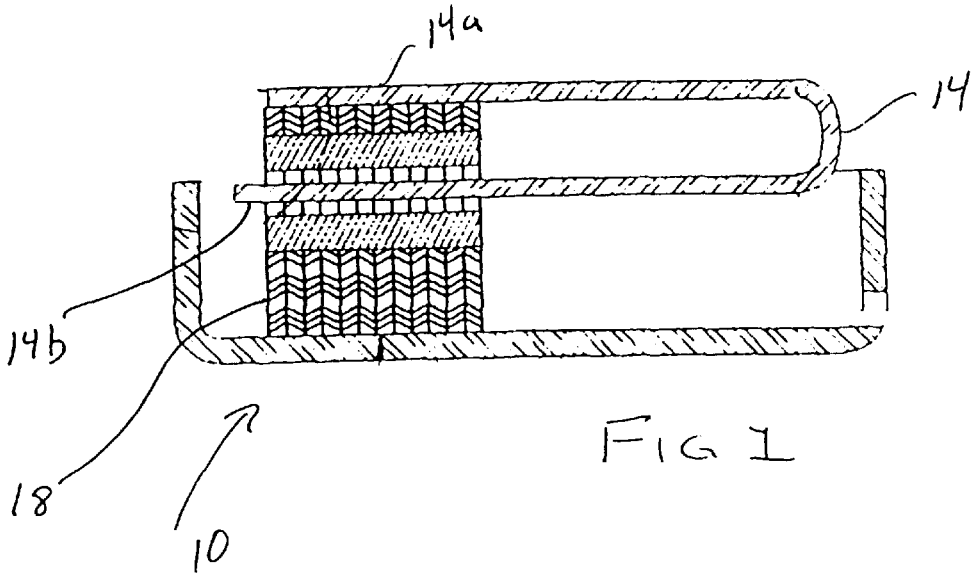
FIG. 1 is a sectional view of a receiver in accordance with the present invention.

A receiver 10, such as for a conventional, miniaturized hearing aid (not shown), is illustrated in FIGS. 1 and 2. As is well known, the receiver 10 converts electrical energy, such as from a microphone (not shown) to acoustical energy.

The receiver 10 comprises an armature 14 having a fixed end 14*a* and a movable end 14*b*. Excitation of the receiver 10 by the electrical energy causes the movable end 14*b* of the armature to move, thereby driving a diaphragm to create the acoustical energy. The armature fixed end 14*b* includes a peripheral edge 14*c*.

The receiver further includes a magnet stack 18. In order to fix the fixed end 14*a*, means are provided for attaching the armature fixed end 14*a* to the magnet stack 18.

According to the prior art, this attachment was accomplished by bringing the armature into pressure engagement with the stack and resistance welding the armature to the stack. As discussed above, this process resulted in significant heating of the armature and stack, thereby degrading their magnetic properties. Also, this process required significant pressure engagement between the armature and the stack, thereby potentially deforming the stack.

In accordance with the invention, first and second spot welds 20*a*, 20*b*, respectively, are provided to attach the peripheral edge 14*c* of the armature 14 to the stack 18. Because the welds 20*a*, 20*b* are located at the periphery of the armature 14, heating of the stack 18 is minimized. It is contemplated that the spot welds are formed by conventional laser welding.

In addition to the spot welds 20*a*, 20*b*, an adhesive, such as a low viscosity, wicking epoxy, can be disposed between the armature 14 and the stack 18. If an adhesive is used, the spot welds 20*a*, 20*b*, advantageously secure the armature 14 to the stack 18 while the adhesive cures.

The invention further includes a method of manufacturing the receiver 10.

The method comprises providing the armature 14 having the peripheral edge 14*c*, providing the magnet stack 18, bringing the stack 18 adjacent the armature, and welding the armature to the magnet stack at the peripheral edge of the armature. As discussed above, an adhesive, can be disposed between the armature 14 and the stack 18.

While the specific embodiments have been illustrated and described, numerous modifications come to mind without significantly departing from the spirit of the invention and the scope of protection is only limited by the scope of the accompanying claims.

We claim:

1. A receiver for converting electrical energy to acoustical energy comprising:

an armature having a peripheral edge;

a magnet stack secured to the armature by a low viscosity wicking adhesive; and a weld joint positioned substantially along the peripheral edge of the armature to minimize heating of the magnet stack while providing intimate contact between the armature and magnet stack.

2. The receiver of claim 1, wherein the weld joint is a plurality of spot welds that further minimize heating of the magnet stack.

3. The receiver of claim 1, wherein the adhesive is a low viscosity wicking epoxy.

* * * * *